US006511148B1

(12) United States Patent
Colombi et al.

(10) Patent No.: US 6,511,148 B1
(45) Date of Patent: Jan. 28, 2003

(54) INK JET COLOR PRINTER AND RELATIVE METHOD OF OPERATION

(75) Inventors: Alberto Colombi, Banchette (IT); Attilio De Ambrogio, Cigliano (IT)

(73) Assignee: Olivetti Tecnost S.p.A., Ivrea (Turin) (IT)

( * ) Notice: Subject to any disclaimer, the term of this patent is extended or adjusted under 35 U.S.C. 154(b) by 0 days.

(21) Appl. No.: 09/463,243

(22) PCT Filed: Jun. 30, 1998

(86) PCT No.: PCT/IT98/00183

§ 371 (c)(1),
(2), (4) Date: Jan. 21, 2000

(87) PCT Pub. No.: WO99/02348

PCT Pub. Date: Jan. 21, 1999

(30) Foreign Application Priority Data

Jul. 9, 1997 (IT) ..... TO97A0612

(51) Int. Cl.[7] ..... B41J 29/393
(52) U.S. Cl. ..... 347/19; 347/14
(58) Field of Search ..... 347/19, 40, 43, 347/14; 358/1.8; 235/462.01; 324/693

(56) References Cited

U.S. PATENT DOCUMENTS 5,053,814 A 10/1991 Yoshiaki et al.
5,067,835 A 11/1991 Takemi et al.
6,128,098 A * 10/2000 Kamada et al. ..... 358/1.8
6,227,649 B1 * 5/2001 Hirabayashi et al. ..... 347/40

FOREIGN PATENT DOCUMENTS

JP 02116847 A * 5/1990

OTHER PUBLICATIONS

Patent Abstracts of Japan, vol. 016, No. 030 (M–1203), Jan. 24, 1992 & JP 03 240541 A (Canon Inc.), Oct. 25, 1991.
Patent Abstracts of Japan, vol. 013, No. 320 (M–853), Jul. 20, 1989 & JP 01 105769 A (NEC Corp.), Apr. 24, 1989.
Patent Abstracts of Japan, vol. 017, No. 041 (M–1359), Jan. 26, 1993 & JP 04 260540 A (Brother Ind. Ltd.) Sep. 16, 1992.

* cited by examiner

*Primary Examiner*—Shih-Wen Hsieh
(74) *Attorney, Agent, or Firm*—Banner & Witcoff, Ltd.

(57) ABSTRACT

An ink jet color printer (10) comprises a printer body (15) having a casing with a rear wall (17) provided with a slot (13) in which an interchangeable, disposable type paper cassette (18) containing printing media with given common characteristics is removably inserted; the paper cassette bears are at least 5-bit binary (19) indicating the characteristics of the printing media it contains inside and which is read by the electronic controller (21) of the printer so as to automatically select the optimum printing mode in relation to the specific characteristics of the printing media, thus avoiding mistakes on the part of the user.

16 Claims, 3 Drawing Sheets

INK JET COLOR PRINTER AND RELATIVE METHOD OF OPERATION

BACKGROUND OF THE INVENTION

Figure 1:
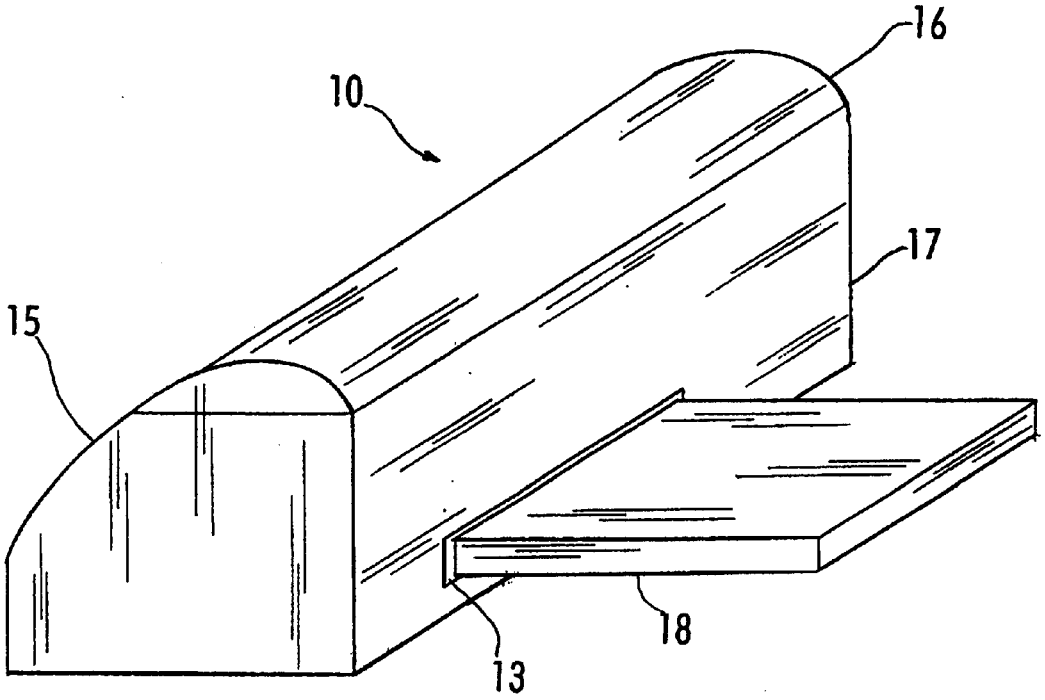

This invention relates to a printer used to produce images (mostly, though not exclusively, photographic images) in black, but more often in colour, on a printing medium (for example, a sheet of paper, treated or untreated, or a sheet of plastic, of variable format) by means of the ink jet technology (either thermal or piezoelectric type), and, more particularly, to a printer provided with a removable and interchangeable paper cassette containing a plurality of said printing media, having the same format and the same physical-chemical characteristics.

STATE OF THE ART

Printers of the type described above are known in the art, that use printing means generally in the form of ink jet print heads, in some cases capable of printing a whole line at a time (line heads), but more often mounted by fixed or interchangeable means on a scanning carriage.

The composition and general mode of operation of an ink jet printer, as also those of the associated ink jet printhead, are already widely known in the sector art, and will not therefore be described in detail herein, the description accordingly being limited to a more detailed account of some characteristics of relevance to the understanding of the present invention, taking as a reference the example of a colour printer provided with scanning carriage and using the thermal ink jet technology.

A typical ink jet colour printer of the type indicated above schematically comprises:

a system, selectively actuated by a motor, for the feeding of the sheet of paper upon which the image is to be produced, so that the feeding occurs in a given direction in discrete steps (line feed), a movable carriage, sliding on ways in a direction perpendicular to that of feeding of the sheet, selectively driven by a motor to accomplish an outward motion and a return motion across the entire width of the sheet itself, a printhead removably affixed to the carriage, comprising a plurality of emission resistors deposited on a substrate (usually a silicon wafer) and arranged inside cells filled with ink, individually connected to a corresponding plurality of nozzles, through which the head is able to emit the droplets of ink contained in a tank, which may be an integral part of the head, in the case of the so-called monobloc or disposable heads; or it may be interchangeable, being removably fitted on the head, in the case of the so-called refillable type heads. The tank contains at least three different inks, corresponding to the primary colours, cyan, magenta and yellow, an electronic controller which, on the basis of the information received from a computer the printer is connected to and of the presettings effected by the user, selectively controls both the above-mentioned motors and the printhead, causing therein, through the selective heating of the resistors, the emission of the droplets of ink against the surface of the printing medium, generating a visible image thereon.

The presettings that may be effected by the user, as is known in the sector art, concern particularly the printing mode that is to be implemented, in order to produce a printout having a printed colour quality, assessed in terms of uniformity, brilliance, correspondence with the original and separation between adjacent colours, consistent with the use that is to be made of the document and the type of printing medium upon which the document in question is to be produced.

For example, the presettable printing modes, in order of increasing quality and decreasing economy, are those indicated with terms such as "draft", "economy", "standard", "high quality" or "presentation". These modes control the presetting of suitable factors such as, for example, the resolution of the image decomposition grid (for example, 300×300 or 600×600 dots/inch$^2$); the direction of scanning during printing (for example, monodirectional or bidirectional); the consumption of ink (for example, by reducing the number of dots printed from 100% to 75%, to 50% or to 25%); the inking speed (for example, by application of a technique known as "shingling", i.e. printing a line with a variable number of head passes, involving one or more nozzles), for example, low speed with shingling of 30%, average speed with shingling of 50%, or high speed without shingling.

The five different printing modes described above are represented in summary form by way of example in table T1 below:

TABLE T1

| | SCANNING | CONSUMPTION | SPEED | RESOLUTION |
|---|---|---|---|---|
| DRAFT | BIDIRECTIONAL | 25% | HIGH | 150 × 150 |
| ECONOMY | BIDIRECTIONAL | 75% | HIGH | 150 × 300 |
| STANDARD | BIDIRECTIONAL | 100% | HIGH | 300 × 300 |
| HIGH QUALITY | BIDIRECTIONAL | 100% | AVERAGE | 300 × 600 |
| PRESENTATION | MONODIRECTIONAL | 100% | LOW | 600 × 600 |

The type of printing medium on which to produce the document can be selected by the operator from a wide range of options; for example, it may be plain paper, of the type used in photocopiers; glossed paper, surface-treated on one side only for a glossy finish; coated paper, with the same characteristics as glossy paper, but with a very smooth surface; transparent glossy plastic, for use with a projector; all of different formats and different weights and thicknesses.

The final document quality depends on the selected combination of printing mode and printing medium. It will be clear, however, from the above that the large number of variables represents a factor of confusion for the operator, giving rise to a considerable degree of difficulty in making the right choice, even if hard-copy or on-line manuals are available to guide the operator in making this choice.

All the more so when the user of the printer is not a professional user, which is exactly the case with the non-professional colour printers called "photographic" that have recently appeared on the market. These are intended for a general, not necessarily adult, public for the printing of photographs produced with digital cameras, known in the art, and which, instead of producing a chemical image on a negative or positive film, produce a digital file of a format suitable for being printed by a colour printer, usually thermal or ink jet type; or, alternatively, for the printing of photographs or slides produced using traditional methods, but subsequently digitized using known type scanner equipment.

Selection of a wrong combination of printing mode and type of medium produces poor results, with a consequent waste of materials (ink and media) and leaves the user dissatisfied.

The patent JP 3,240,541 discloses the use of a sensor to detect the medium width, in order to modify printing parameters accordingly.

The U.S. Pat. Nos. 5,067,835 and 5,053,814 disclose the use of a paper cassette having a bar code or similar to identify some characteristics of the medium, or order to optimize the printing output.

However, the cited prior art documents leave some problems unsloved, because the number of informtion items is limited by the number of sensors or by the extension of the code, and some characteristics of the medium are lost. The control of the printing parameters based on said informations cannot keep into account non standard variables, e.g. a special type of coating, a cross-correlation amongst some variables, or a combinating of variables leading to a surprising behavior of the printout.

SUMMARY OF THE INVENTION

The scope of this invention is to define an ink jet colour printer that avoids the problem described above, ensuring that the correct combination is always made between printing mode and type of medium on which to print the photographic image, thereby eliminating the problems of poor quality of the printed image and wasted materials due to the user's lack of skill.

Another scope of the invention is to define an ink jet colour printer provided with a removable and interchangeable cassette for accommodating the printing media, marked with a code for the type of medium it contains; and with a system for reading this code for the corresponding automatic setting of the correct printing mode in relation to the type of medium.

A further scope of the invention is to define an ink jet colour printer provided with a printhead interchangeable with others of different characteristics; with a system for recognition of the specific characteristics of the printhead in the machine; with a removable and interchangeable cassette for accommodating the printing media, marked with a code for the type of medium it contains; and with a system for reading this code for the corresponding automatic setting of the correct printing mode in relation both to the type of printhead and to the type of medium.

A further scope of the invention is to mark such cassette with a code identifying all the characteristics of the medium as a whole, thereby allowing the direct selection of the right printing mode also in presence of non standard variables, cross-correlations amongst some variables, or combinations of variables leading to a surprising behavior of the printout.

An ink jet colour printer, characterized as defined in the main claim, is capable of fully attaining the above scopes.

These and other scopes, characteristics and advantages of the invention will become clear from the following description of a preferred embodiment, provided by way of a non-exhaustive example and with reference to the accompanying drawings.

LIST OF THE FIGURES

FIG. 1—Is a schematic representation of a perspective rear view of a colour printer according to the invention, provided with a removable and interchangeable cassette for accommodating the printing media.

Figure 2:
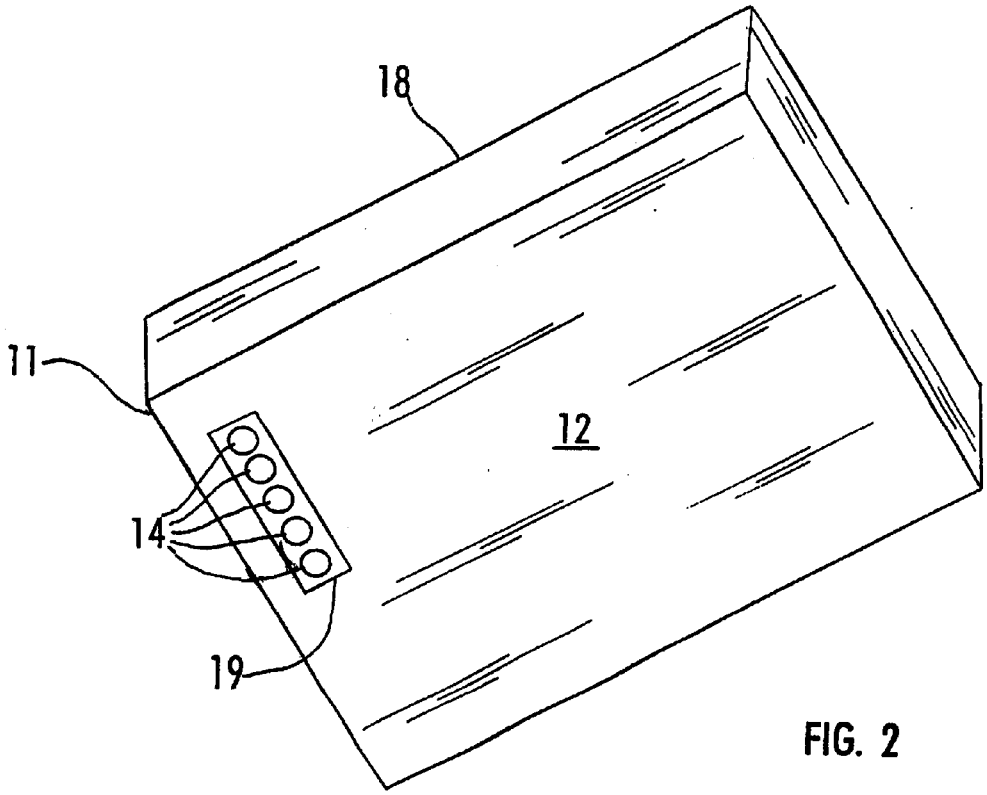

FIG. 2—Is a schematic representation of a cassette for accommodating the printing media suitable for being interchangeably fitted on the printer of FIG. 1.

Figure 3:
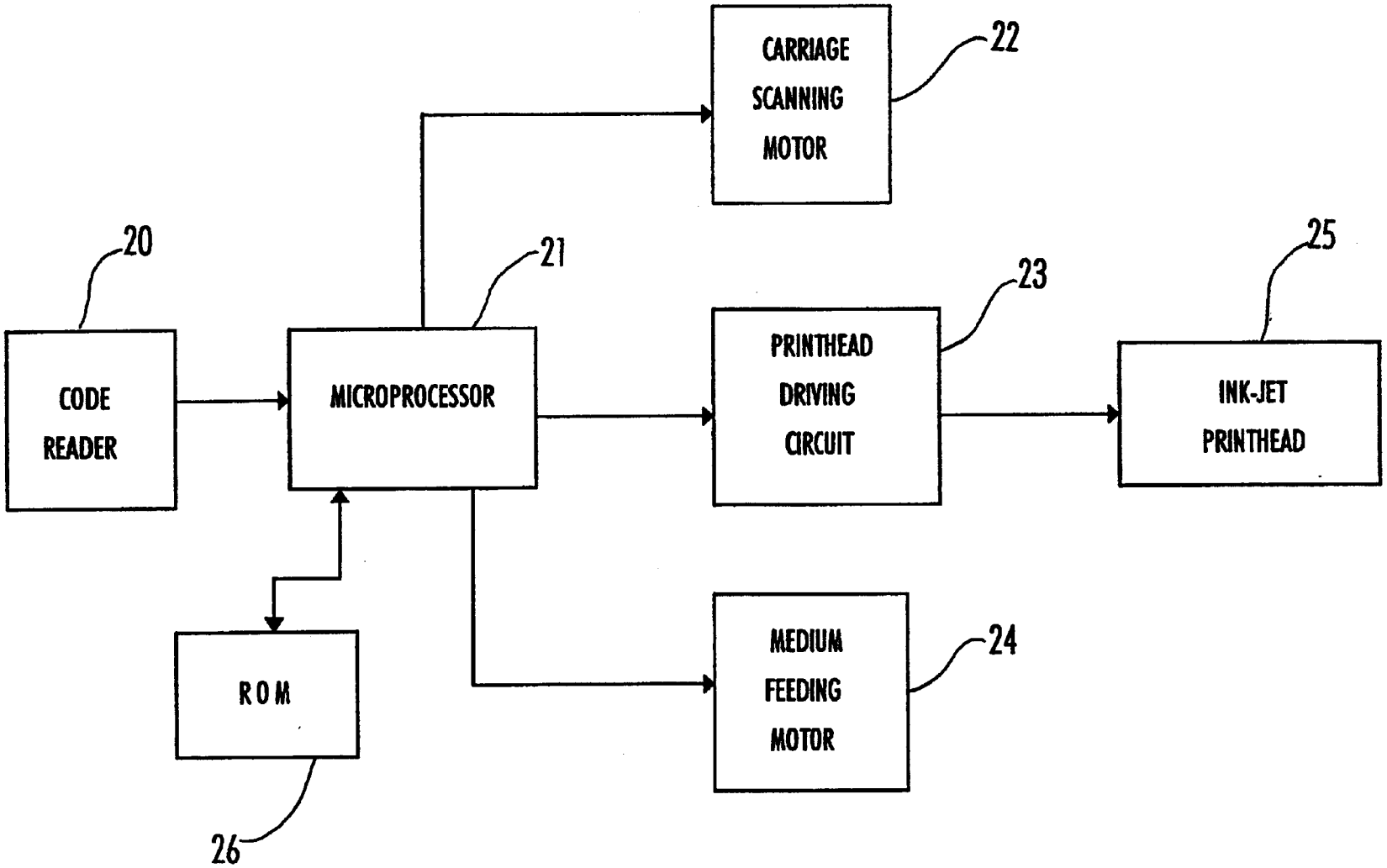

FIG. 3—Is a simplified block diagram of the printer of FIG. 1.

Figure 4A:
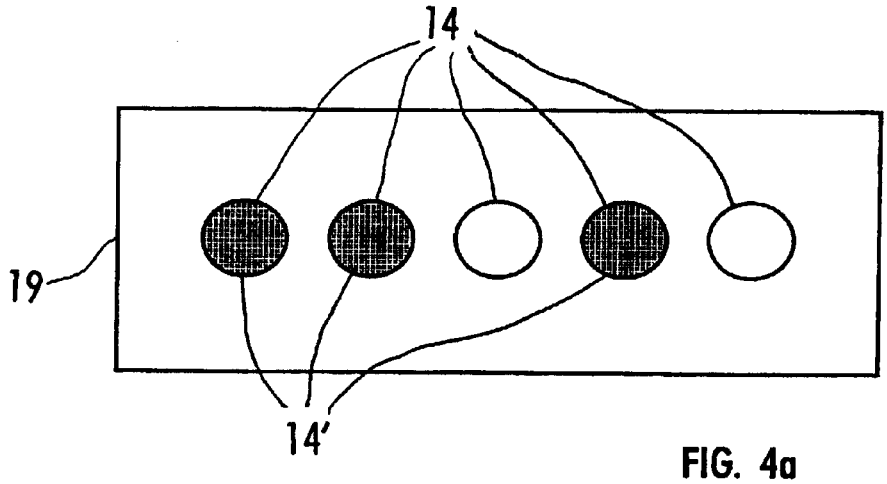

FIG. 4*a*—Is a schematic representation of the coding zone of the paper cassette of the printer of FIG. 1 in a first illustrative example.

Figure 4B:
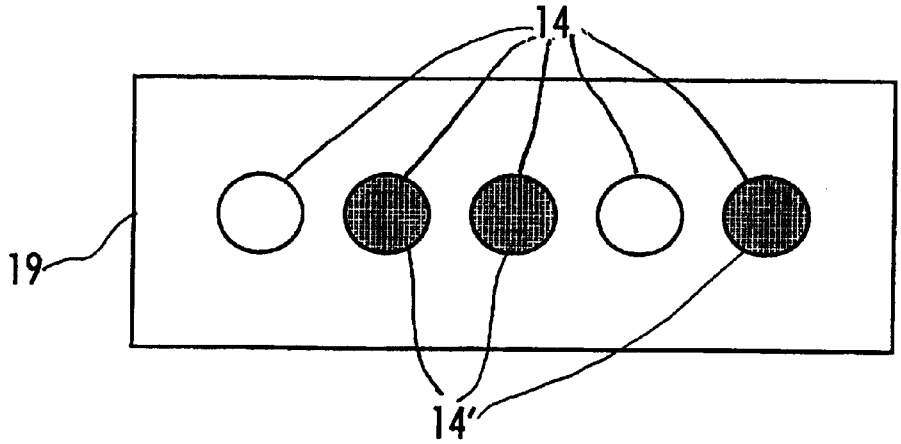
Figure 4C:
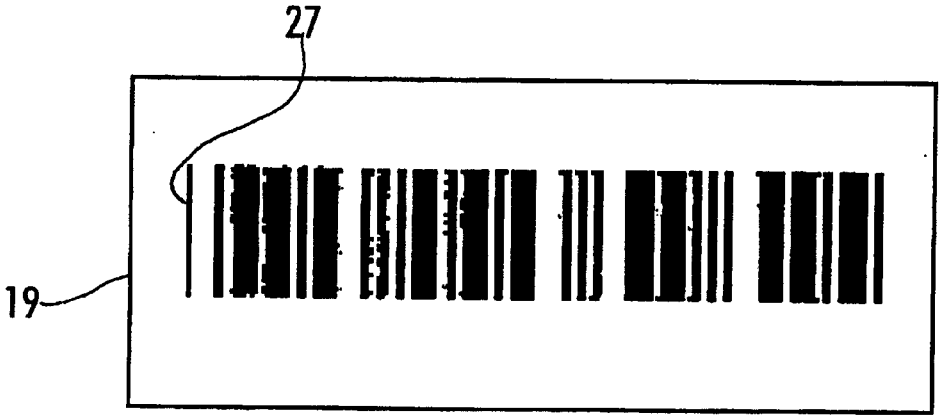

FIG. 4*c*—Is a schematic representation of the coding zone of the paper cassette of the printer of FIG. 1 in a second illustrative example.

FIG. 4*b*—Is a schematic representation of the coding zone of the paper cassette of the printer of FIG. 1 in a third illustrative example.

DESCRIPTION OF THE PREFERRED EMBODIMENT

Shown in FIG. 1 is an ink jet colour printer 10, comprising a printer body 15, inside which are located, in particular, a carriage upon which a printhead is mounted, a carriage scanning motor, a paper feed motor, a sheet pick-up device and a microprocessor-based electronic controller (not visible in the figure). The printer body 15 has a casing provided with a lid 16 enabling access to the internal members previously cited, and a rear wall 17 in which a slot 13 has been made, suitable for at least partially accommodating a paper cassette 18, substantially parallelepiped in shape, containing printing media in the form a pile of overlaid, aligned sheets.

The paper cassette 18 is of the "disposable" type, that is to say, it is supplied with an initial provision of a certain number of sheets and, after the latter have all been used, it is thrown away and not used any more.

The paper cassette 18 (FIG. 2) has a front wall 11, which is inserted into the slot 13 in the casing of the printer body 15, connected to a bottom wall 12, of substantially rectangular format and of slightly larger dimensions than the sheets (not seen in the figure) contained inside the paper tray 18; the bottom wall 12, in the vicinity of the front wall 11, is provided with a reading zone 19 bearing a coding system. An example of the system is illustrated in the figure as a line of 5 code elements 14 comprised by a circular surface, each of which may be of the optically reflective or optically opaque type, so as to produce $2^5$ different code combinations, by means of which up to 32 different types of printing media may be identified, differing both in format and also in other chemical-physical characteristics, such as for example, thickness, weight, roughness, transparency, opaqueness, base material type, presence of a surface coating, and, in the latter case, the roughness, opaqueness, reflectivity and chemical composition of the surface coating.

The combination between codes and printing media is effected during the paper cassette production process, so that a paper cassette with a different code for each type of printing medium may be made available commercially.

When the paper cassette 18 is inserted inside the slot 13, the sheets contained inside are in correspondence with the sheet pick-up device, which is accordingly able to selectively feed the sheets to a printing zone, whereas the reading zone 19 is in correspondence with a code reader 20 (FIG. 3), for example a known type reflection optical reader, which is accordingly able to differentiate the code elements 14 and thus "read" the code that they represent, identifying the type of medium contained in the paper cassette 14.

The code reader 20 provides the code read to a microprocessor 21 included in the electronic controller of the printer 10; the microprocessor 21 in turn is capable of selectively commanding the medium feed motor 24 and the carriage scanning motor 22, and of controlling a circuit 23 for driving of the ink jet printhead 25, all on the basis of a medium type and relative optimum printing mode cross-reference table, stored in a read-only memory (ROM) 26.

The methods of operation of the ink jet colour printer according invention will now be described below.

Depicted in FIG. 4*a* is the reading zone 19 of the paper cassette 18 in the case where, as an indicative example for the sole purposes of illustrating operation of the present invention, 3 of the code elements 14, shown in grey and indicated with the numeral 14', are reflective, signifying in this way that the paper cassette 18 contains a pile of 10×15 cm format sheets of paper of 150 g/m$^2$, having an upper side covered with a PVA film with a smooth external surface. When the paper cassette 18 bearing this specific code is inserted in the printer 10, the code reader 20 (FIG. 3) reads it and provides it to the microprocessor 21 which, on the basis of the cross-reference table stored in the ROM 26, identifies the "Presentation" printing mode as the most suitable and correspondingly, upon receiving a print command from the operator, effects a monodirectional printing, at low speed with 30% shingling, 100% consumption and resolution of 600×600 dots/inch$^2$.

A second example, again indicative for the sole purposes of illustrating operation of the present invention, is represented in FIG. 4*b,* wherein the reading zone 19 of the paper cassette 18 has 3 other reflective code elements 14, again shown in grey and indicated with the numeral 14', signifying in this way that the paper cassette 18 contains a pile of 10×15 cm format sheets of plain paper weighing 80 g/m$^2$; when the paper cassette 18 bearing this code is inserted inside the printer 10, the code reader 20 (FIG. 3) reads it and provides it to the microprocessor 21 which, on the basis of the cross-reference table stored in the ROM 26, identifies the "Draft" printing mode as the most suitable and correspondingly, upon receiving a print command from the operator, effects a bidirectional printing, at high speed without shingling, with 25% consumption and resolution of 150×150 dots/inch$^2$.

In general, each time a paper cassette 18 is inserted into the printer 10, the code reader 20 reads the code marked in the reading zone 14 and provides it to the microprocessor 21 which, on the basis of the cross-reference table stored in the ROM 26, identifies and applies the most suitable printing mode upon reception of a print command.

In a possible variant of the ink jet colour printer 10 previously described, in addition to the paper cassette 18, the printhead 25 is also interchangeable, and may thus be replaced not only when the ink in the tank runs out, but may also be replaced by another head having different characteristics, for example because it also contains a black ink as well as the cyan, magenta and yellow coloured inks. In this case, the electronic controller of the printer is capable of recognizing the type of printhead present, according to ways known and applied in the art, so as to define an optimum printing mode, selected in relation both to the type of head and to the type of paper cassette present A further variant of what has been described above consists in additionally providing the ink jet colour printer 10 with display means, through which the electronic controller of the printer provides the user, who has inserted a given paper cassette 18, information about which printhead 25 it would be preferable to fit to be able to effect, when required, the best mode of printing for the best possible quality or the best compromise between quality and economy; or, vice versa, it provides the user, who has fitted a given printhead 25, information about which paper cassette 18 it would be preferable to insert to be able to effect, when required, the best mode of printing for the best quality possible or the best compromise between quality and economy.

Naturally changes may be made to the invention as described above, without exiting from the scope of the invention.

For example, use is possible of a bar code type coding system 27, as illustrated in FIG. 4*c,* permitting an exceptionally large quantity of different combinations, in combination with a known type optical code reader 20; or a coding system not based on optical reflection, but on transparency, using the known type optoelectronic fork method. It is also possible to use a mechanical rather than optical coding system, detecting for example particular shapes made in the paper cassette 18 by means of known type microswitches.

The principle of the invention could also be applied to a printhead 25 wherein the tank is removably affixed to the head true and proper, thus representing an interchangeable tank.

Then again, the principle of the invention could also be applied to an ink jet printhead comprising, in addition to the primary colour inks of cyan, yellow and magenta, other diluted colour inks and/or one or more black inks, whether or not physically and chemically compatible with the colour inks.

Finally the principle of the invention could be applied to an ink jet printhead using the piezoelectric rather than thermal technology, for generation of the droplets of ink.

In short, without prejudice to the principle of the present invention, the construction details and forms of embodiment may be amply varied with respect to those described and illustrated in the foregoing, without exiting from the scope of the invention.

What is claimed is:

1. Ink jet colour printer comprising a printer body having a casing with a rear wall, said printer body including:

a system for pick-up and feeding of a printing medium;

a printhead mounted on a scanning carriage for generating an image on said printing medium;

a paper cassette of the disposable type;

an electronic controller comprising a microprocessor for commanding according to a given printing mode among a plurality of given printing modes said system for pick-up and feeding of said printing medium, said scanning carriage and said printhead; and a memory for storing a plurality of said given printing modes, said rear wall further including a slot, a type of printing media being of given common characteristics, and being accommodated in said paper cassette removably inserted in said slot so that said printing media cooperate with said pick-up and feeding system, wherein said paper cassette possesses first identifying means defining a at least 5 bit binary code suitable for identifying as a whole one of plurality of different types of printing media contained within said disposable paper cassette, and that said electronic controller further comprises first detecting means for detecting said first identifying means defining said at least 5 bit binary code present on said paper cassette, and selection means cooperating with said first detecting means for automatically selecting from said memory one of said given printing modes in relation to said type of printing media.

2. Printer according to claim 1, wherein said first identifying means comprise at least one code element of the optically reflecting type.

3. Printer according to claim 1, wherein said first identifying means comprise at least one code element of the optically transparent type.

4. Printer according to claim 1, wherein said first identifying means comprise at least one code element of the bar code type.

5. Printer according to claim 1, wherein said first detecting means comprise an optical reader.

6. Printer according to claim 1, wherein said first detecting means comprise a microswitch.

7. Printer according to claim 1, wherein said printhead is interchangeably fitted on said scanning carriage, and said electronic controller further comprises means for recognising the type of said printhead, characterized in that said selection means cooperate with said recognising means for automatically selecting from said memory one of said given printing modes.

8. Printer according to claim 1, wherein said printhead is of the thermal ink jet type.

9. Printer according to claim 1, wherein said printhead is of the piezoelectric ink jet type.

10. Printer according to claim 1, wherein said printhead comprises a tank containing at least one ink selected from a set consisting of a cyan ink, a magenta ink, a yellow ink and a black ink.

11. Printer according to claim 10, wherein said tank is of an interchangeable type.

12. Printer according to claim 1, wherein said given printing modes comprise at least one printing characteristic selected from a set consisting of scanning direction during printing, resolution of the image decomposition grid, ink construction and inking speed.

13. Printer according to claim 12, wherein said scanning direction during printing is selected from the set consisting of monodirectional scanning and bidirectional scanning.

14. Printer according to claim 12, wherein said resolution of the image decomposition grid is selected from the set consisting of resolution of 150×150 dots/inch$^2$, resolution of 150×300 dots/inch$^2$, resolution of 300×300 dots/inch$^2$, resolution of 300×600 dots/inch$^2$ and resolution of 600×600 dots/inch$^2$.

15. Printer according to claim 12, wherein said ink consumption is selected from the set consisting of 100% consumption, 75% consumption, 50% consumption and 25% consumption.

16. Printer according to claim 12, wherein said inking speed is selected from the set consisting of no shingling, 50% shingling, and 30% shingling.

* * * * *